US010670374B2

(12) United States Patent
Storch

(10) Patent No.: US 10,670,374 B2
(45) Date of Patent: Jun. 2, 2020

(54) FIREARM ACCESSORY INTERCHANGEABLE MOUNT SYSTEM

(71) Applicant: Midwest Industries, Inc., Waukesha, WI (US)

(72) Inventor: Troy Storch, Wales, WI (US)

(73) Assignee: Midwest Industries, Inc., Waukesha, WI (US)

( * ) Notice: Subject to any disclaimer, the term of this patent is extended or adjusted under 35 U.S.C. 154(b) by 0 days.

(21) Appl. No.: 15/867,328

(22) Filed: Jan. 10, 2018

(65) Prior Publication Data

US 2018/0195838 A1 Jul. 12, 2018

Related U.S. Application Data

(60) Provisional application No. 62/444,441, filed on Jan. 10, 2017.

(51) Int. Cl.

| | |
|---|---|
| ***F41G 11/00*** | (2006.01) |
| ***F41A 3/66*** | (2006.01) |
| ***F41C 27/00*** | (2006.01) |

(52) U.S. Cl.

CPC ..... *F41G 11/003* (2013.01); *F41A 3/66* (2013.01); *F41C 27/00* (2013.01); *F41G 11/001* (2013.01)

(58) Field of Classification Search

CPC ..... F41C 27/00; F41G 11/003; F41G 11/004; F41G 1/387

See application file for complete search history.

(56) References Cited

U.S. PATENT DOCUMENTS

| | | | | |
|---|---|---|---|---|
| 2,425,130 | A * | 8/1947 | Shelley | F41G 11/008 42/127 |
| 3,834,052 | A * | 9/1974 | Steck, III | F41G 11/001 42/124 |
| 4,367,606 | A * | 1/1983 | Bechtel | F41G 11/003 42/127 |
| 5,787,630 | A | 8/1998 | Martel | |
| 5,887,375 | A | 3/1999 | Watson | |
| 6,381,895 | B1 | 5/2002 | Keeney et al. | |
| 6,678,988 | B1 | 1/2004 | Poff, Jr. | |
| 6,722,075 | B1 | 4/2004 | Gabaldon | |
| 6,886,288 | B1 * | 5/2005 | Yocum | F41G 11/003 42/124 |
| 7,908,782 | B1 | 3/2011 | LaRue | |
| 8,020,335 | B2 | 9/2011 | Larsson et al. | |
| 8,024,884 | B2 | 9/2011 | Holmberg | |

(Continued)

FOREIGN PATENT DOCUMENTS

| | | | | |
|---|---|---|---|---|
| EP | 2775254 | A1 * | 9/2014 | F41G 11/003 |

*Primary Examiner* — Benjamin P Lee

(74) *Attorney, Agent, or Firm* — Boyle Fredrickson S.C.

(57) ABSTRACT

A system or assembly for securing accessories to an underlying firearm assembly. The accessory mounting assembly includes a base that is constructed to be secured to a mount plate that is securable to an underlying firearm. An accessory support is securable to the base and moveable in a horizontal lateral direction relative thereto. An engagement or interface arrangement is provided between the base and the accessory support such that the accessory support can be translated in a lateral direction that is orthogonal to a bore of the underlying firearm and is constructed to provide vertical association of discrete accessory supports relative to the base.

20 Claims, 13 Drawing Sheets

(56) References Cited

U.S. PATENT DOCUMENTS

| | | | | |
|---|---|---|---|---|
| 8,161,674 | B2 | 4/2012 | Holmberg | |
| 8,327,574 | B2 | 12/2012 | Sandler et al. | |
| 8,720,103 | B2 * | 5/2014 | Schultz | F41G 11/003 42/124 |
| 8,726,562 | B1 * | 5/2014 | Hoskisson | F41G 11/003 42/124 |
| 9,470,480 | B2 * | 10/2016 | Kirchhoff | F41G 11/001 |
| 2002/0162267 | A1 | 11/2002 | Nelson et al. | |
| 2005/0132631 | A1 * | 6/2005 | Bodo | F41G 1/40 42/118 |
| 2007/0157503 | A1 | 7/2007 | Holmberg | |
| 2008/0000465 | A1 | 1/2008 | Holmberg | |
| 2008/0072471 | A1 | 3/2008 | Keng | |
| 2009/0205240 | A1 | 8/2009 | Dextraze | |
| 2010/0011649 | A1 | 1/2010 | Holmberg | |
| 2013/0118051 | A1 * | 5/2013 | Baker | F41G 11/003 42/90 |
| 2014/0068994 | A1 * | 3/2014 | Schultz | F41G 11/003 42/124 |
| 2018/0023924 | A1 * | 1/2018 | Storch | F41G 11/00 42/90 |

* cited by examiner

FIREARM ACCESSORY INTERCHANGEABLE MOUNT SYSTEM

CROSS REFERENCE TO RELATED APPLICATIONS

This application claims priority to U.S. Provisional Patent Application Ser. No. 62/444,441 filed on Jan. 10, 2017 titled "Firearm Accessory Interchangeable Mount System" and the disclosure of which is incorporated herein.

FIELD OF THE INVENTION

The present invention relates to firearm accessory mounting arrangements that are configured to secure lighting and/or sighting accessories relative to an underlying firearm. More specifically, the present invention relates to an accessory mounting assembly wherein the mount assembly can be quickly and repeatably associated with a mount plate secured to an underlying firearm and wherein an accessory mounting surface can be laterally positioned for use with the underlying firearm.

BACKGROUND OF THE INVENTION

Firearm sight assemblies generally include an ocular or sight that is attached to the firearm to assist the shooter with aligning the bore of the firearm with an intended target. Commonly, the shooter adjusts either of the sight relative to the firearm, or the orientation of the sight relative to the target, to accommodate different shooting conditions such as windage and/or projectile inclination or declination conditions that may exist between the shooter and the intended target. Advancements in firearm capabilities and sighting and/or target lighting systems have resulted in firearm sighting systems and shooting conditions wherein shooters commonly desire to quickly, efficiently, and accurately associated one or more sighting devices relative to the underlying firearm and more suitable to a giving shooting condition. Further, different shooting conditions can present situations where it is desired to associate multiple sighting accessories, such as scopes, sights, lights, magnifiers, etc., relative to the underlying firearm in a manner wherein the discrete devices cooperate with one another in a manner wherein both devices are used concurrently during shooting activities.

Regardless of the intended use of one sighting device, multiple sighting devices, or the desire to change the discrete sighting devices to accommodate different shooting conditions, positioning of the discrete sighting devices relative to the underlying firearm must be highly repeatable to mitigate repeated sighting in of the firearm each time an additional or alternate sighting device is associated with the line of sight of the firearm. Failure to adequately attend to the repeatability of the association of the sighting accessories with the underlying firearm can render the underlying firearm unsuitable to achieve a requisite or desired degree of accuracy associated with subsequent use of the firearm with the respective or desired underlying sighting accessories.

Still further, many firearm sighting accessories are commonly provided with unique connection methodologies associated with securing the underlying accessory relative to an underlying firearm. Lack of uniformity or ability to cooperate between discrete sighting accessories and respective underlying accessory mounting systems detracts from the ability of the user to quickly and accurately associate discrete sighting accessories with firearms equipped with dissimilar accessory mounting systems. Configuring a discrete firearm for use with discrete firearm accessories that have been previously configured for use with another firearm having a dissimilar accessory mounting system is not an activity that can be commonly or conveniently completed in the field or during shooting activities. Further, such activities commonly require access to specialized tools or the like to effectuate the respective dissociation between a respective accessory and the underlying accessory mounting systems and subsequent association of the discrete accessory with an accessory mounting system having an alternate configuration but a configuration suitable for use or cooperation with an alternate accessory mounting system. Still further, accessories configured for cooperation or operation with one accessory mounting system commonly require additional mounting members or structures to achieve a desired operative association between such an accessory and an alternate accessory mounting system. Such considerations detract from the ability to quickly and repeatably associate a discrete accessory between respective firearms.

Accordingly, there is a need for a firearm accessory mounting system that can be quickly and accurately associated with alternate firearms. There is a further need for a firearm accessory mounting system that is configured to cooperate with a variety of discrete accessories and configured to cooperate with different mounting methodologies associated with commercially available sighting accessories.

SUMMARY OF THE INVENTION

The present invention discloses a firearm accessory mounting system or assembly and method of forming a firearm accessory mounting system that allows an accessory associated with the accessory mount system to be aligned for use with the underlying firearm and subsequently removed and repeatably associated with a mount plate secured to the firearm for subsequent use of the respective accessory in association with the respective firearm.

One aspect of the application discloses a firearm accessory mount assembly having a base that removably cooperates with a mount plate affixed to a receiver of an underlying firearm. An accessory support is constructed to be secured to the base such that a longitudinal axis of the accessory support is adjustable in a lateral direction relative to a longitudinal axis of the mount plate. The accessory mount assembly is constructed to achieve a desired longitudinal alignment of an accessory and the underlying firearm when the firearm is in use and such that the accessory and mount assembly can be readily removed and repeatably associated with an underlying firearm when use of the accessory is desired.

Another aspect of the application that is useable or combinable with the above features and aspects discloses a firearm accessory mounting system that includes a base that is constructed to removably cooperate with a mount plate that is affixed to a receiver of an underlying firearm. An accessory support is constructed to be secured to base such that a longitudinal axis of the accessory support is adjustable in a lateral direction relative to a longitudinal axis of the mount plate. A first engagement interface and a second engagement interface are formed between the base and the accessory support. The first engagement interface and the second engagement interface are constructed to provide an orthogonal association of the accessory support relative to the base throughout a range of adjustment of the accessory support relative to the base with respect to the lateral and longitudinal directions.

Another aspect of the application that is useable or combinable with the above features and aspects discloses a firearm accessory mounting system that includes a base and an accessory support. The base includes a channel formed in a firearm facing side of the base and that is constructed to slideably cooperate with a mount plate secured to a receiver of a firearm. The accessory support is constructed to cooperate with the base. A first channel and a second channel are defined by one of the base of the accessory support and a first projection and a second projection are defined by the other of the base and the accessory support. The first projection is constructed to cooperate with the first channel and the second projection is constructed to cooperate with the second channel to align a longitudinal axis of the base with a longitudinal axis of the accessory support when the accessory support is secured to the base. The first projection and the second projection are constructed to removeably engage with a respective one of the first channel and the second channel in a vertical direction.

Another aspect of the application that is useable or combinable with the above features and aspects discloses a method of forming a firearm accessory mounting system that includes providing a base that removably cooperates with a mount plate secured to a rearward portion of a firearm. A first and a second base indexing structure are defined by a vertically facing surface of the base. A plurality of accessory mounts are provided that each cooperate with the base. A first and a second accessory mount indexing structure are defined by a downward facing surface of each of the plurality of accessory mounts such that the first accessory mount indexing structure is configured to slideably cooperate with the first base indexing structure and the second accessory mount indexing structure is configured to slideably cooperate with the second base indexing structure when a respective one of the plurality of accessory mounts is vertically translated relative to the base such that each of the first and second accessory mount indexing structures engage a respective one of the first base indexing structure and the second base indexing structure when a respective accessory mount is secured to the base.

These and various other aspects, features, and advantages of the present invention will be made apparent from the following detailed description and the drawings.

BRIEF DESCRIPTION OF THE DRAWINGS

The drawings illustrate various preferred embodiments presently contemplated for carrying out the invention.

DETAILED DESCRIPTION

Figure 1:
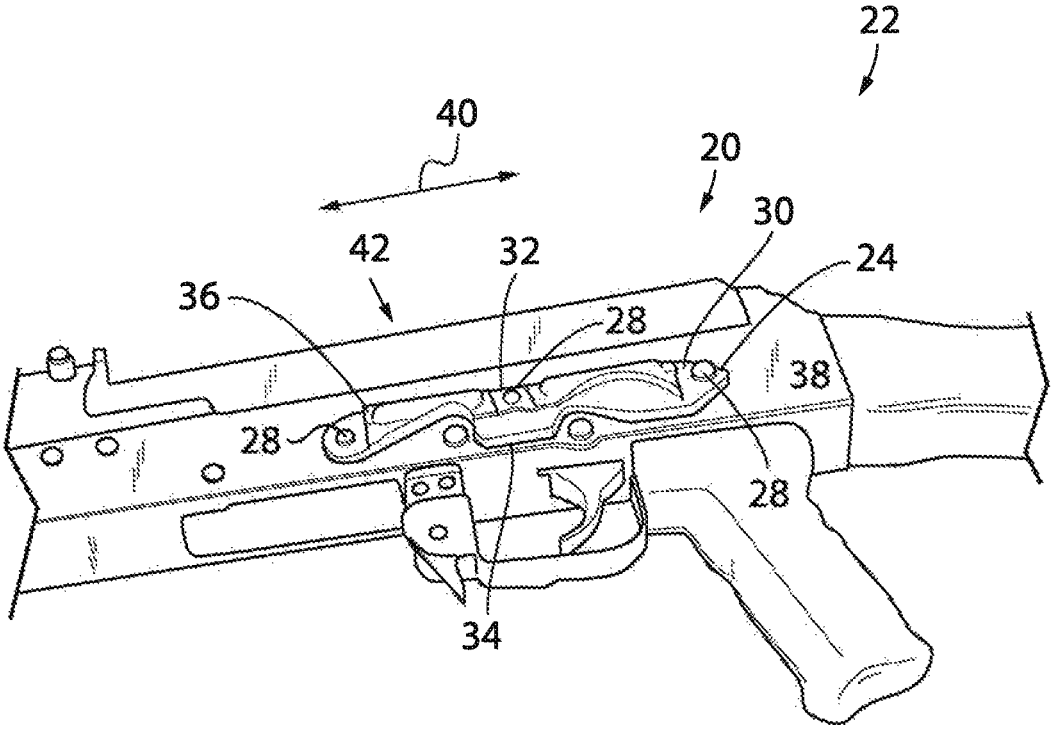
FIG. 1 is a partial perspective view of a firearm having a mount plate secured thereto and that is constructed to removeably cooperate with the accessory mounting system according to the present invention.
Figure 2:
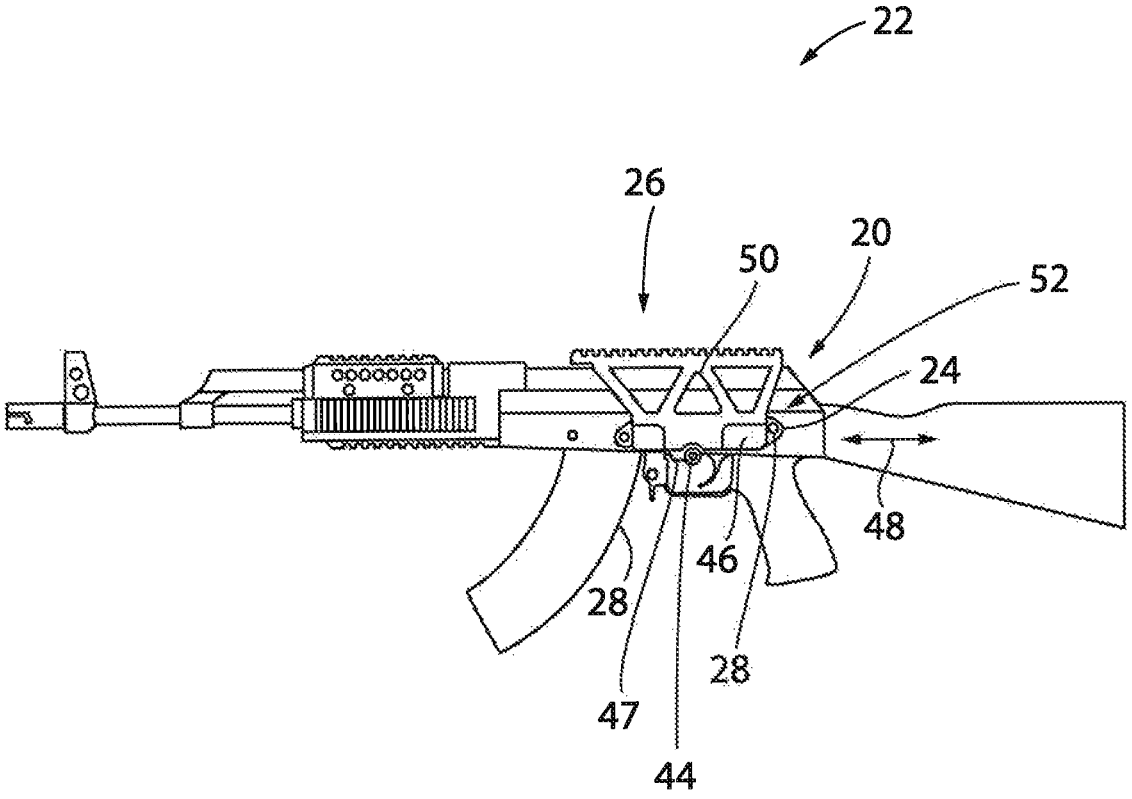
FIG. 2 is a side elevation view of the firearm shown in FIG. 1 with an accessory mounting system according to the present invention engaged with the mount plate of the underlying firearm.

FIG. 1 shows a receiver 20 of a firearm 22 having a mount plate 24 affixed thereto and FIG. 2 shows firearm 22 with an accessory mounting system or assembly 26 according to the present invention operatively associated with mount plate 24. Mount plate 24 is constructed to slideably receive an accessory mount assembly 26 according to the present invention. Those skilled in the art will readily recognize firearm 22 as a WASR10 or AK47 style firearm wherein mount plate 24 is secured to receiver 20 via one more rivets 28, fasteners, or the like. That is, mount plate 24 is generally not adjustable relative to receiver 20 once secured thereto but provides a robust and secure interface for securing accessories or accessory mount assemblies as disclosed in the present application relative to the underlying firearm 22. It should be appreciated that mount plate 24 can be secured to a receiver or stock associated with the underlying firearm 22.

Mount plate 24 includes a rear facing surface 30, an upward facing surface 32, a downward facing surface 34, and a forward facing surface 36 that each extend in a generally outward lateral direction relative to a plane defined by a sidewall 38 of receiver 20. Mount plate 24 extends in a longitudinal direction, indicated by line 40, which is generally aligned with the longitudinal axis of receiver 20. A longitudinal center portion 42 of mount plate 24 is constructed to cooperate with a release assembly 44 attached or otherwise associated with a base 46 of accessory mount assembly 26. Release assembly 44 is preferably provided in a quick-release methodology wherein release assembly 44 can be engaged and disengaged from mount plate 24 in a preferably tool-less manner.

As shown in FIG. 2, release assembly 44 includes a handle 46 that is rotatable relative to base 46 between a closed position, as shown in FIG. 2, and an open position that is generally rearward of the orientation shown in FIG. 2. It should be appreciated that the axis of rotation associated with operation of handle 46 would be perpendicular relative to the view shown in FIG. 2. When in the closed position, release assembly 44 secures base 46 relative to mount plate 24 and when in the open position, base 46 is slidable in a longitudinal direction, indicated by arrow 48, relative to mount plate 24 to accommodate the selective placement and/or removal of accessory mount assembly 26 relative to the underlying firearm 22. Preferably, when release assembly 24 is "open", base 46, and a respective accessory mount or support associated therewith, are slideable in a generally rearward direction relative to firearm 22 to effectuate the desired removal of the respective accessory mounting system or assembly 26 therefrom.

Accessory mount assembly 26 includes an accessory support 50 that can be secured to base 46. As disclosed further below, an engagement interface 52 is formed between accessory support 50 and base 46 to accommodate the desired lateral relative positioning of accessory support 50, and thereby any sighting or lighting accessory associated therewith, with respect to base 46 when base 46 is secured to underlying firearm 22. As also disclosed below, engagement interface 52 provides an orthogonal lateral or perpendicular translation of accessory support 50 relative to base 46 to achieve the desired alignment of an accessory associated therewith relative to operation of the underlying firearm 22. Preferably, the cooperation between discrete accessory supports 50 and base 46 includes at least two, similarly constructed, engagement interfaces associated with the cooperation of discrete accessory supports 50 and the underlying base 46.

FIGS. 3-9 show various views of accessory support assembly 26 with quick release assembly 44 removed therefrom and accessory support assembly 26 removed from firearm 22. For clarity, various fasteners have also been removed from assembly 26. Referring to FIGS. 3-9 and 19-24, base 46 is defined by a body 54 having an atmosphere facing side 56 and a mount plate facing side 58 that is generally opposite thereto. Mount plate facing side 58 of body 54 of base 46 includes a channel 60 that is defined by an open end 62 and a closed end 64 relative to a longitudinal axis of channel 60.

A rib 66 extends along at least a portion of a top surface of channels 60 and is constructed to abut top surface 32 of mount plate 24 when base 46 is engaged therewith. An end wall 68 associated with closed end 64 of channel 60 is constructed to abut rear facing surface 30 of mount plate 24 when base 46 is engaged therewith. Engagement between end wall 68 and rear facing surface 30 provides a repeatable association between base 46 and mount plate 24 in a longitudinal direction generally aligned with the bore of firearm 22.

Body 54 of base 46 includes a cutout 70 associated with accommodating quick release assembly 44 supported by base 46. Quick release assembly 44 is constructed to include a projection that is translatable in a generally vertical direction, indicated by arrow 72, relative to body 54 of base 46 during operation of handle 47. When oriented in the closed position, quick release assembly 44 biases lip 66 into engagement with top surface 32 of mount plate 24 and the overlapping portion of quick release assembly 44 engages lower facing surface 34 in an overlapping orientation thereby securing base 46 relative to mount plate 24.

Abutting engagement between end wall 68 of base 46 and surface 30 of mount plate 24, and the selectively operable closure associated with release assembly 44 provides a readily repeatable orientation of base 46 relative to mount plate 24 during placement and removal of accessory mount system 26 to the underlying firearm 20.

A top surface 78 of base 46 includes a pair of channels 80, 82 that each have a generally trapezoidal shaped cross-sectional areas. Said in another way, the cross sectional area associated with channels 80, 82 decreases as the channels progress in a downward direction relative to top surface 78 of base 46 such that channels 80, 82 have a tapered or trapezoidal cross sectional shape when considered in laterally extending directions that oriented transverse to a longitudinal axis of the base 46 that is aligned with a bore of an underlying firearm. The generally open or non-overlying shape associated with channels 80, 82 allows expedient association of a discrete accessory mount relative thereto and allows such an association in a manner that mitigates the collection of dirt, debris, or other obstructions which could detract from a suitable robust and positionally secure connection associated with the engagement interface 52 therebetween.

A threaded opening 88 is associated with each channel 80, 82 and is constructed to receive a fastener (not shown) associated with securing a respective accessory support or mount 50 relative to base 46. As disclosed further below, the cooperation between accessory mount 50 and base 46 is constructed to allow limited lateral translation, or translation in a direction that is normal to the axis associated with the bore of the underlying firearm, between accessory mount 50 and base 46 to provide a useable orientation of accessories associated with accessory mount 50 relative to the underlying firearm.

Figure 5:
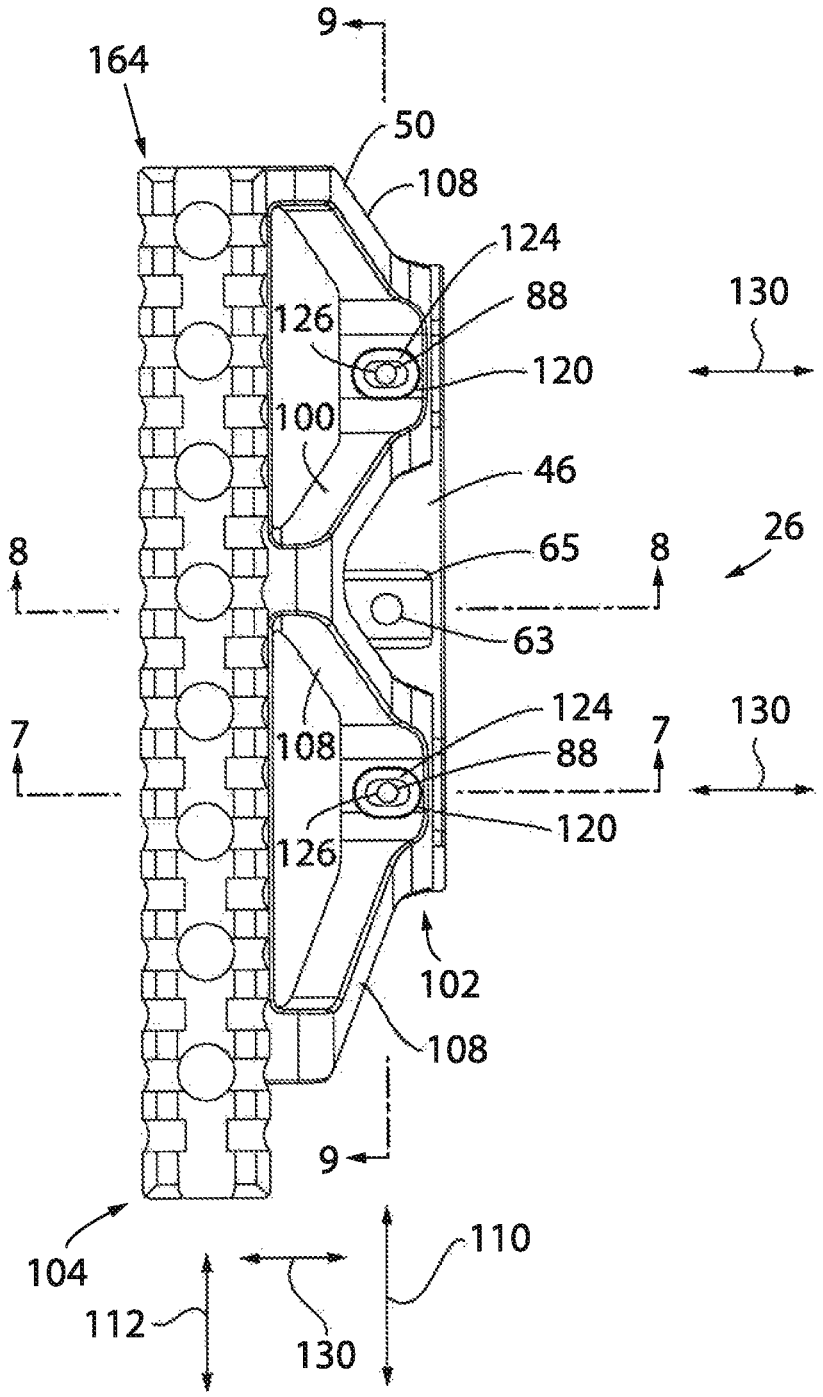
FIG. 5 is a top plan view of the accessory mounting system shown in FIG. 4.
Figure 6:
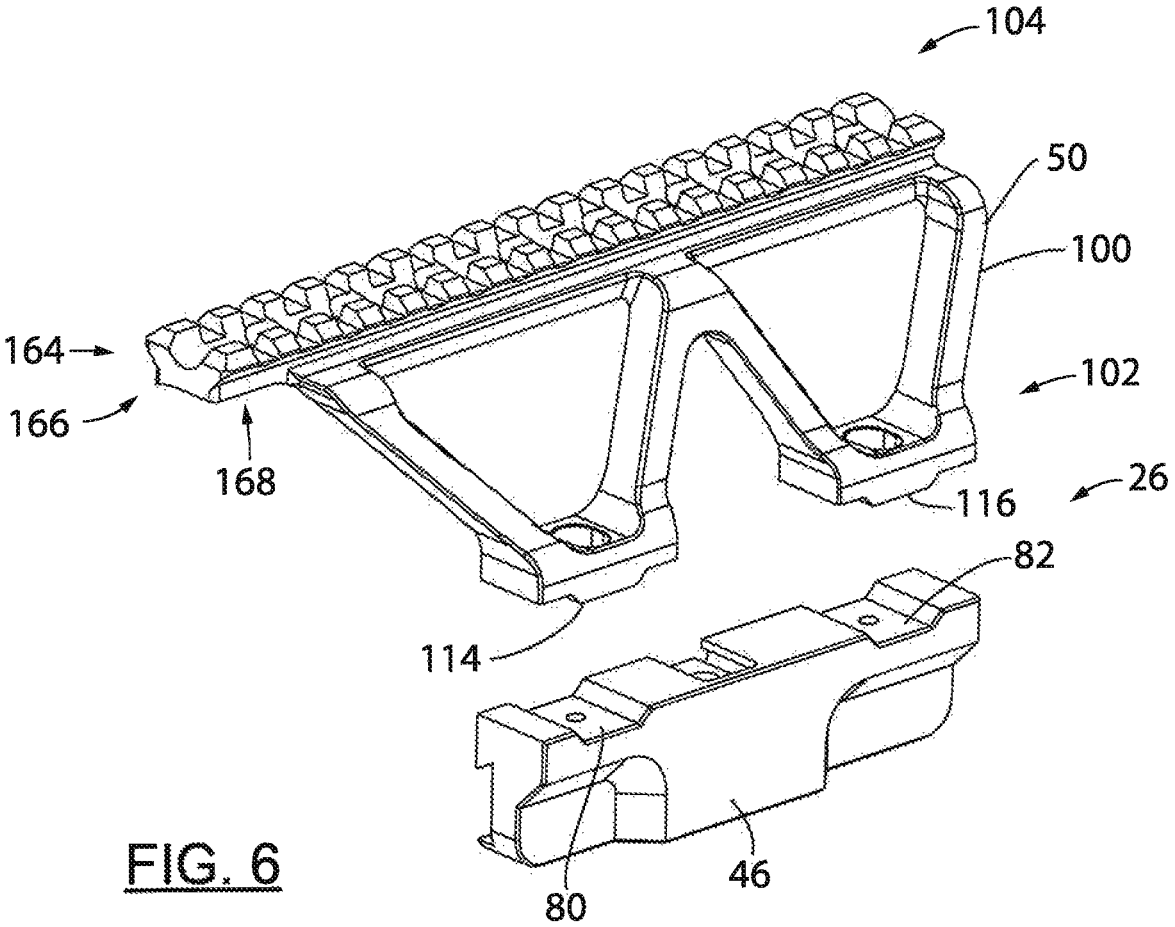
FIG. 6 is a view similar to FIG. 3 and shows the accessory support disengaged from the base of the accessory mounting system.

Referring to FIGS. 3-7, accessory mount 50 is defined by a body 100 having a lower end 102, an upper end 104, and one or more posts 108 that extend between lower end 102 and upper end 104 of body 100. Understandably, posts 108 could be provided in a more solid configuration but doing so could negatively impact the weight associated with utilization of accessory mounting system 26. Referring to FIG. 5, posts 108 are shaped to offset the longitudinal axis, indicated by line 110, associated with lower end 102 of body 100 from a longitudinal axis, indicated by line 112, associated with upper end 104 of body 100. The lateral distance between axes 110, 112 generally represents the distance between the sidewall associated with receiver 20 and the center line associated with the bore of the firearm.

Figure 3:
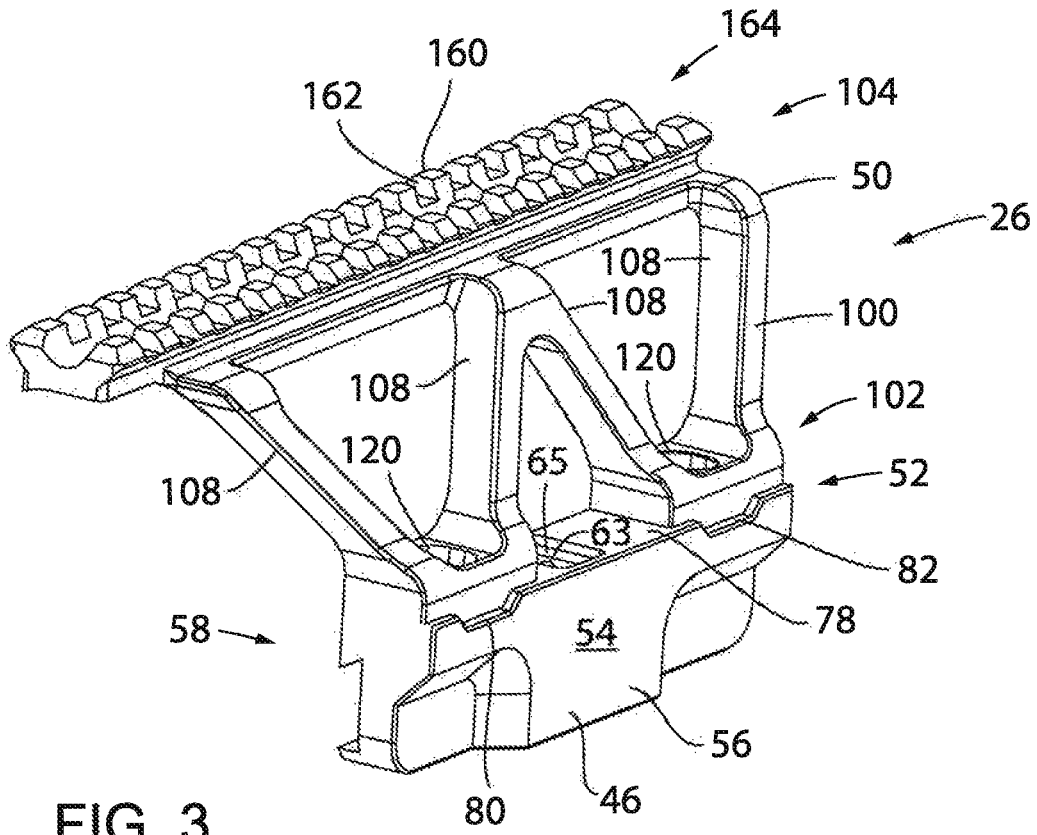
FIG. 3 is a perspective view of the firearm accessory mounting system shown in FIG. 2 removed from the firearm.
Figure 4:
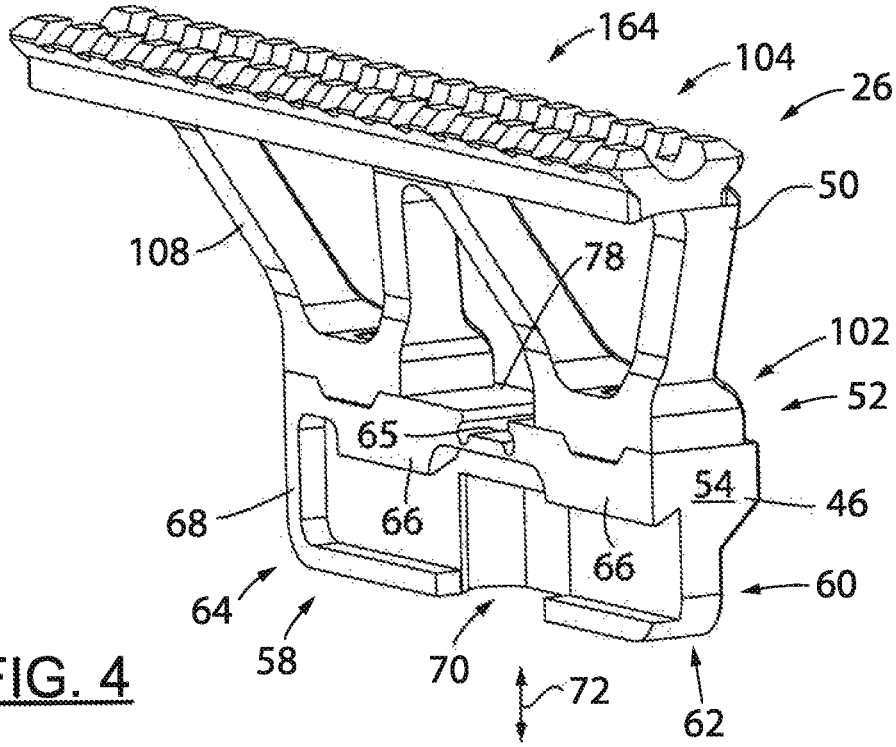
FIG. 4 is a perspective view of a firearm facing side of the accessory mounting system shown in FIG. 3.
Figure 7:
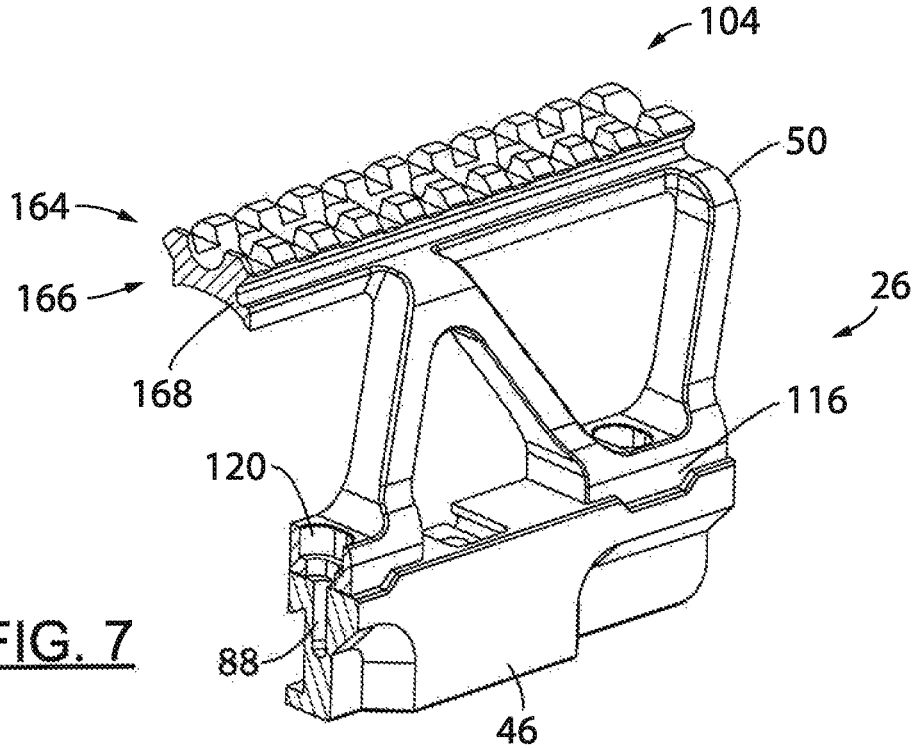
FIG. 7 is a perspective cross section view of the firearm accessory mounting system taken along line 7-7 shown in FIG. 5.
Figure 8:
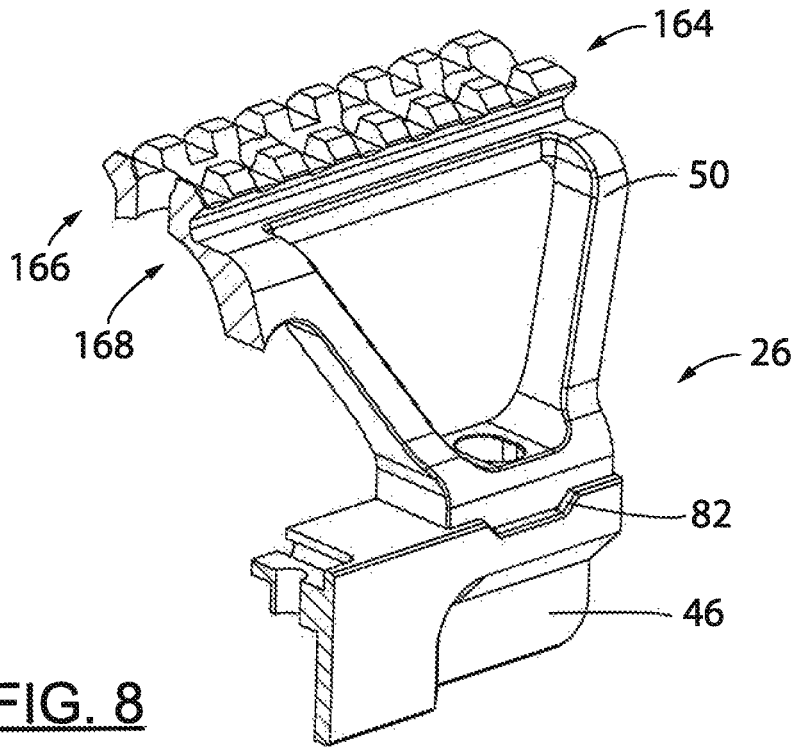
FIG. 8 is a view similar to FIG. 7 taken along line 8-8 shown in FIG. 5.
Figure 9:
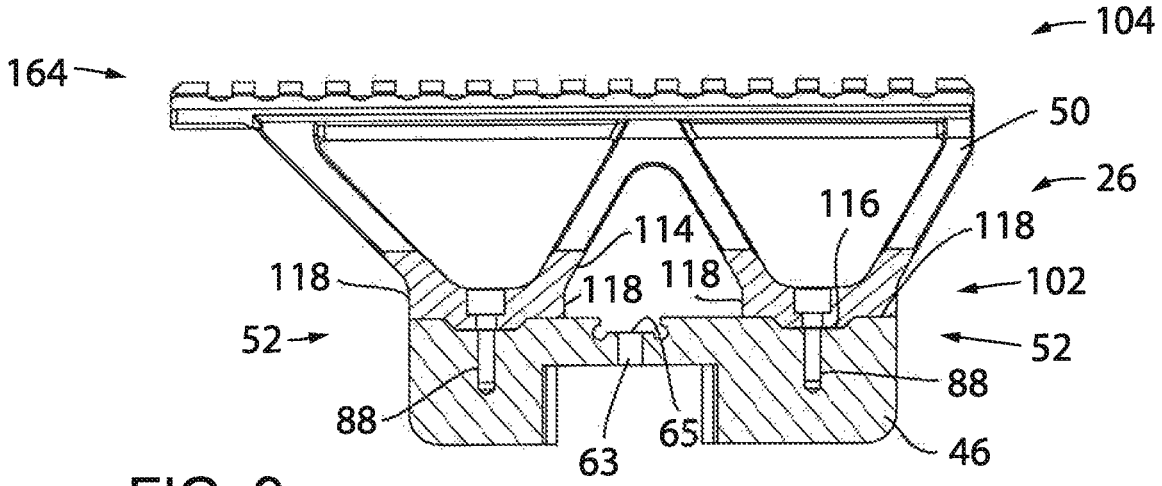
FIG. 9 is an elevational cross section view of the accessory mounting system taken along line 9-9 shown in FIG. 5.

Respective projections 114, 116 extend in a generally downward direction relative to lower end 102 of body 100 of accessory mount 50. Projections 114, 116 are oriented and shaped to cooperate with respective channels 80, 82 defined by base 46. Referring to FIG. 9, projections 114, 116 are flanked by lands 118 so as to provide a generally continuous contact engagement associated with the engagement interface 52 between the contacting portions of base 46 and accessory support 50 when a respective accessory mount is associated with base 46. Referring to FIGS. 3, 5, and 7, an oblong opening 120 is associated with an upward facing surface of accessory support 50 and generally aligned with a relative one of downward extending projections 114, 116. Openings 120 generally define a seat 124 and a through bore 126 associated with accommodating passage of a fastener (not shown) into operative engagement with threaded openings 88 defined by base 46.

The generally oblong shape associated with openings 120 and bore 126 accommodates lateral orthogonal translation, indicated by line 130 (FIG. 5), of accessory support 50 relative to base 46. Such a construction allows the desired spacing between axis 112 associated with accessory support 50 relative to axis 110 associated with base 46 during a sighting operation when a respective accessory is associated with accessory mount 50. Once oriented in the desired position relative to one another and the underlying firearm, the fasteners associated with openings 120 and bores 126 can be tightened thereby fixing the relative orientation between base 46 and accessory support 50 and thereby the relative position of an accessory associated therewith relative to an underlying firearm 22. The generally tapered, but laterally orthogonal, orientation between channels 80, 82 and respective projections 114, 116 facilitates orthogonal lateral translation of accessory support 50 relative to base 46, and thereby adjustment of the accessory relative to a bore of the underlying firearm 22, during the initial configuration of accessory mount assembly 26 with an underlying firearm.

Upper surface 104 of accessory support 50 includes a plurality of corresponding projections 160 and grooves 162, commonly understood as a picatinny rail configuration, which define an accessory engagement interface 164. Opposing sides 166, 168 of engagement interface 164 include overlapping edges configured to cooperate with a securing mechanism and/or quick release assembly such as quick release assembly 44. Projections 166 and grooves 162 provide an adjustable longitudinal engagement between accessories associated therewith and the underlying engagement interface 164 whereas opposing edges 166, 168 provide a secure connection methodology associated with the engagement of an accessory with the engagement interface 164. Said in another way, when accessories are associated with the engagement interface 164, the engagement of the accessory with projections 160 and recesses 164 and respective edges 166, 168 of engagement interface 164 provides a secure physical association between the respective accessory and accessory mount 50. Once associated with the engagement interface 164 and accessory support 50 is secured to base 46, operation of quick release assembly 44 provides repeatable association of the respective accessory and accessory mount system 26, relative to the underlying firearm 22.

It should further be appreciated that not all accessories are configured to cooperate with a picatinny type rail engagement interface such as engagement interface 164. FIGS. 10-18 show various accessory mounts according to alternate embodiments of the present invention. It is appreciated that the accessory mounts shown in the appending drawings are merely exemplary of accessory mounts that are constructed to cooperate with various firearm accessories and that constructions and configurations of the accessory mounts beyond those shown herein are envisioned and within the scope of the appending claims. Regardless of the accessory intended to be connected to a firearm or the specific connection of the accessory mount associated therewith, each accessory mount includes a lower facing structure that is constructed to cooperate with a base having a construction similar to base 46. It is further appreciated that it may be advantageous to some users to have multiple bases 46 and multiple accessory mounts associated with discrete bases, whether the accessory mounts have the same or dissimilar constructions, to facilitate expeditious association of various shooting accessories with a common firearm as a the situation or user preferences may dictate. FIGS. 10-18 show exemplary accessory mounts associated with base 46 for use with firearm 22.

Figure 10:
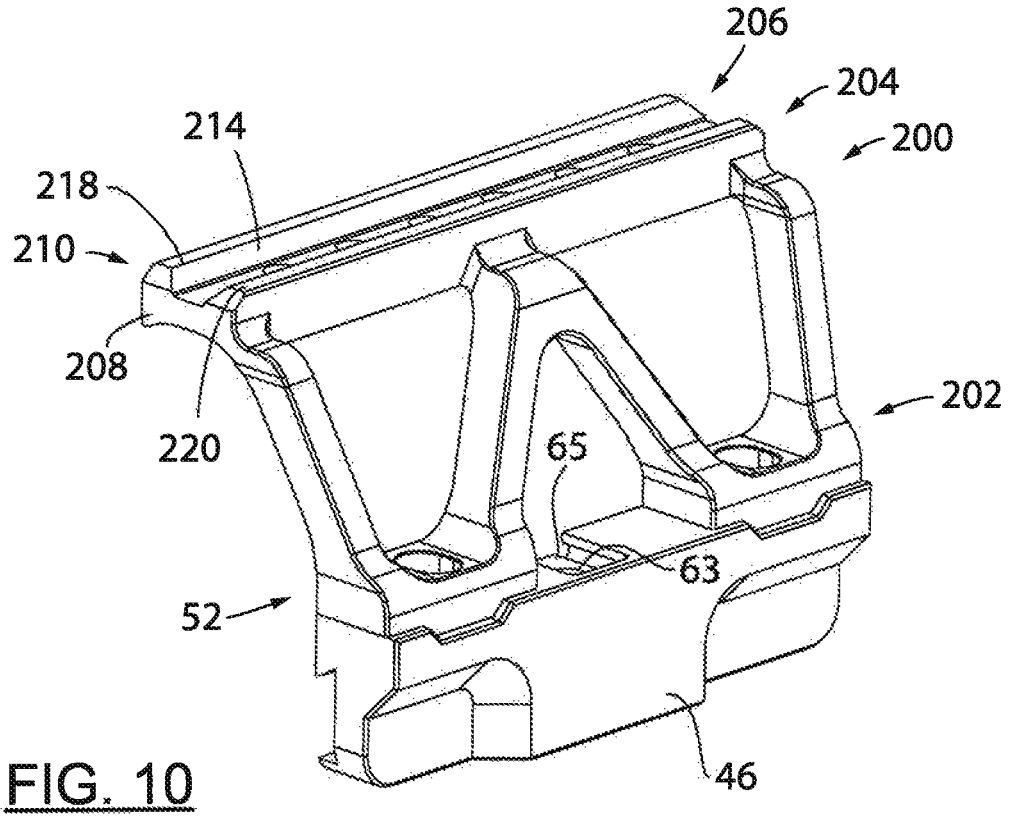
FIG. 10 is a view similar to FIG. 3 and shows an alternate accessory support associated with the base of the accessory support system.
Figure 11:
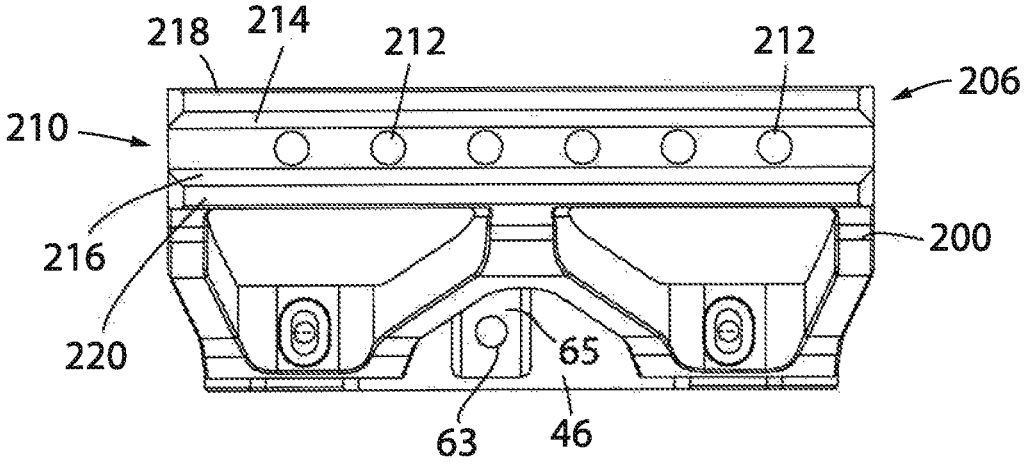
FIG. 11 is a top plan view of the accessory support system shown in FIG. 10.

Referring to FIGS. 10 and 11, an accessory support or mount 200 according to another embodiment of the invention includes a first end 202 that is constructed to cooperate with base 46 and a second end 204 having an alternate accessory engagement interface 206 formed thereat. As alluded to above, the engagement interface associated with the lower end of accessory support 200 is the same as the engagement interface 52 described above with accessory mount or support 50 such that accessory mount or support 200 cooperates with base 46 in the same manner as described above with respect to accessory support 50.

Engagement interface 206 includes a generally elongated rail 208 having a channel 210 and a plurality of openings 212 formed therethrough. Channel 210 includes opposing tapered sidewalls 214, 216 associated with channel 210 and opposing sidewalls 218, 220 associated therewith. Channel 210 is shaped to laterally index a respective accessory relative to accessory mount 200 and openings 212 are oriented to cooperate with a post associated therewith and/or receiver fastener associated with securing a respective accessory relative to accessory mount 200. As mentioned above, engagement interface 52 between accessory mount 200 and base 46 is the same as described above so as to facilitate orthogonal lateral translation of accessory mount 200 relative to base 46 during alignment or sighting operations.

Figure 12:
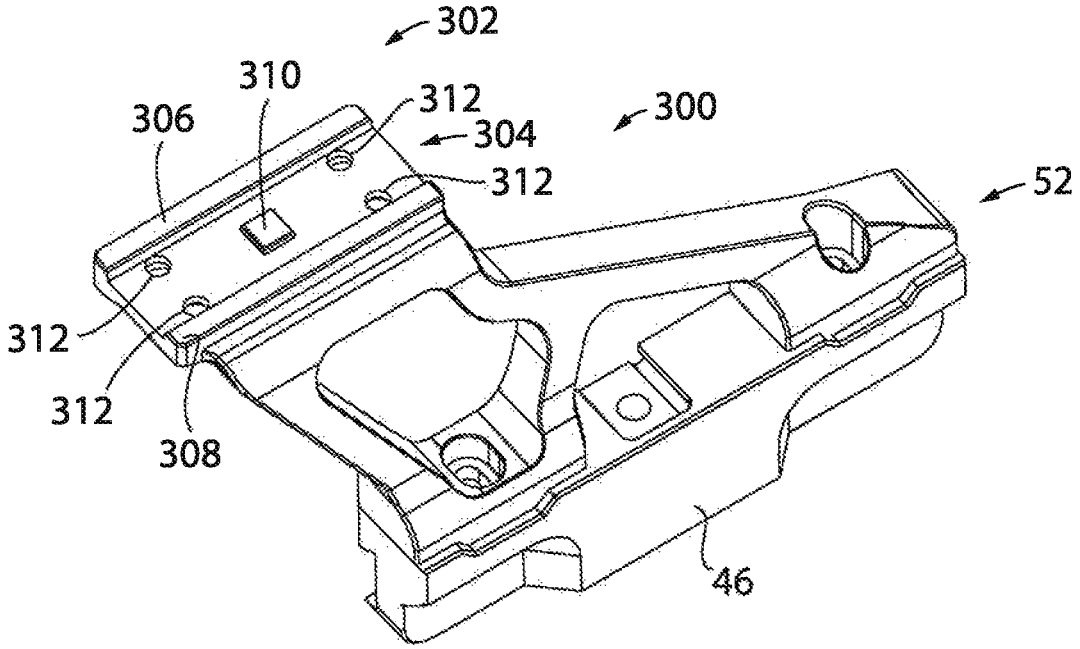
FIG. 12 is a view similar to FIG. 10 and shows another alternate accessory support associated with the base of the accessory mounting system shown in FIG. 3.

FIG. 12 shows an accessory mount 300 according to another embodiment of the invention engaged with base 46. Engagement interface 52 between accessory mount 300 and base 46 is generally similar in construction and operation is that described above with respect to accessory mount 50. Accessory mount 300 includes accessory engagement interface 302 that includes a channel 304 generally defined by opposing sidewalls 306, 308 defined by accessory mount 300. A projection 310 extends from accessory mount 300 proximate channel 304 and is constructed and oriented to index in accessory, such as a dot sight, relative to engagement interface 304. One or more openings 312 pass in a vertical direction through accessory mount 300 relative to channel 304 and are offset from projection 310. Openings 312 are oriented and constructed to cooperate with a post associated with a respective accessory and/or receive a respective fastener associated with securing the respective accessory relative to accessory engagement interface 302.

Figure 13:
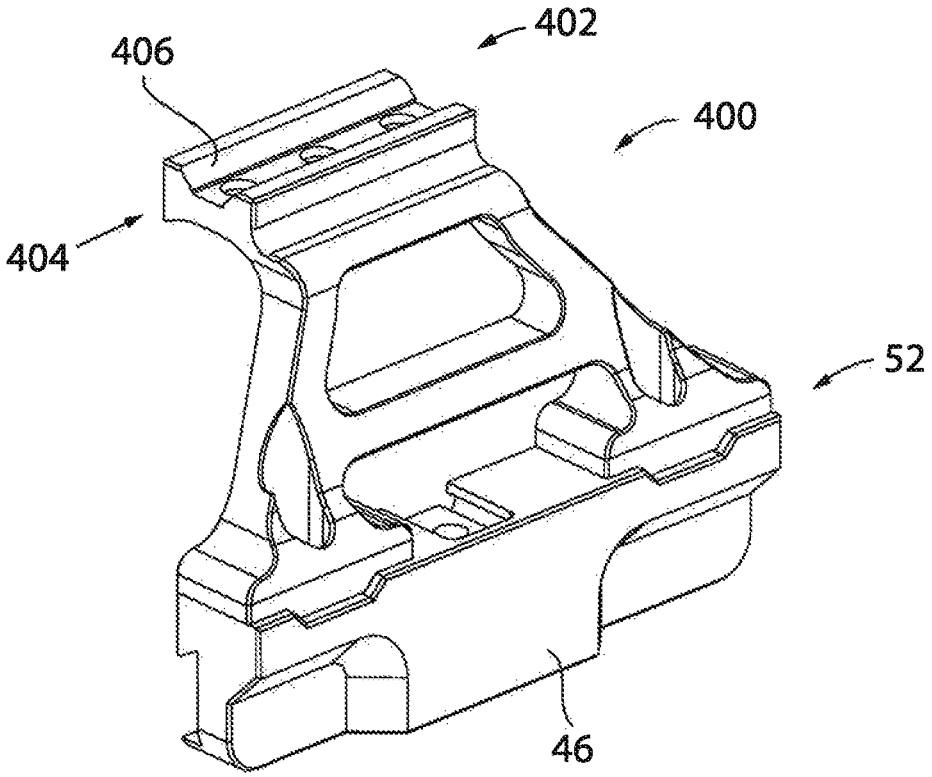
FIG. 13 is a view similar to FIG. 12 and shows another alternate accessory support associated with the base of the accessory mounting system shown in FIG. 3.
Figure 14:
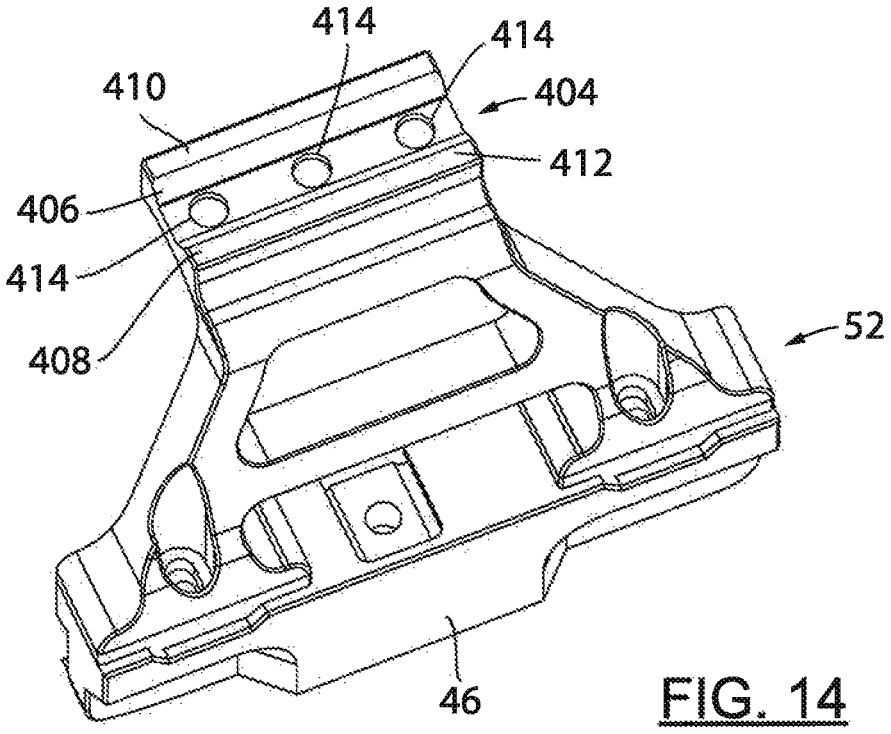
FIG. 14 is a more top oriented perspective view of the accessory mounting system shown in FIG. 13.

FIGS. 13 and 14, show yet another alternative accessory mount 400 associated with base 46 via engagement interface 52. Accessory mount 400 includes an accessory engagement interface 402 that is somewhat similar to engagement interface 204 but has a shorter longitudinal length relative thereto. Accessory engagement interface 402 is defined by a channel 404 defined by opposing tapered sidewalls 406, 408 and respective top walls 410, 412 associated therewith. One or more openings 414 extend in a generally vertical direction through accessory mount 400 and are associated with channel 404 and facilitate cooperation and indexing of the respective accessory relative thereto. Engagement interface 52 between accessory mount 400 and base 46 is similar to that described above such that accessory mount 400 is laterally translatable relative to base 46 during sighting operations.

Figure 15:
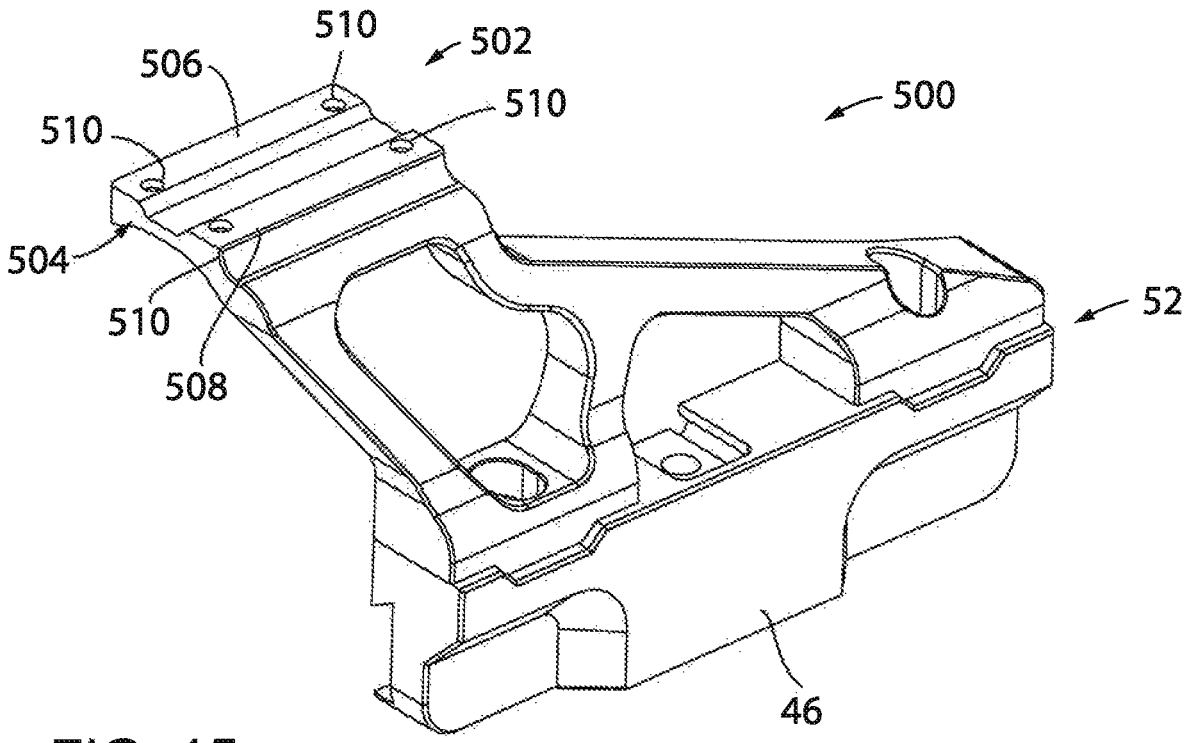
FIG. 15 is a view similar to FIG. 13 and shows another accessory support associated with the base of the accessory mounting system shown in FIG. 3.
Figure 16:
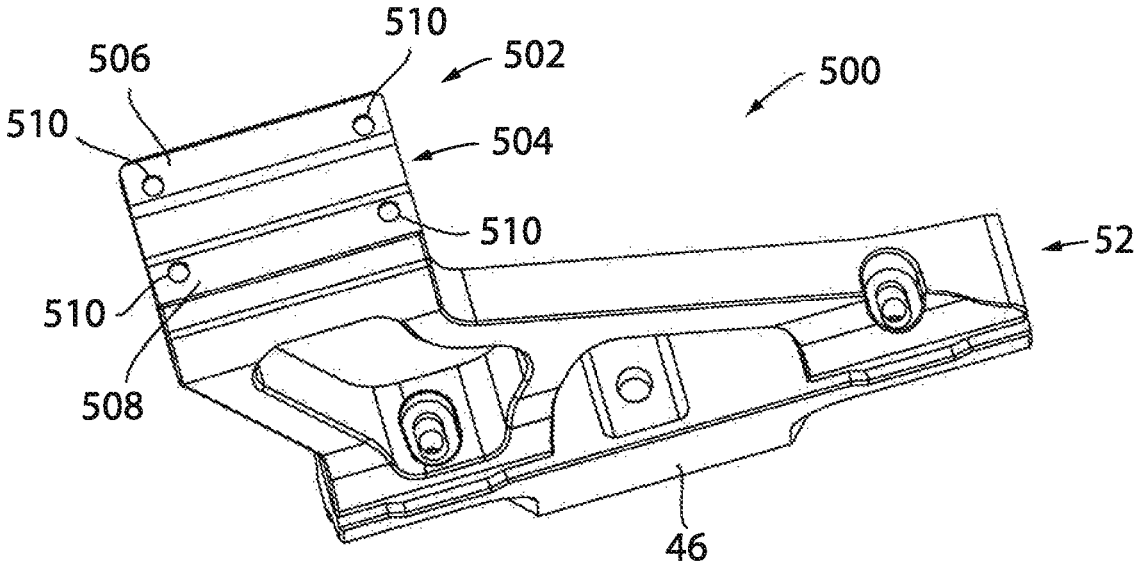
FIG. 16 is a view similar to FIG. 14 of the accessory mounting system shown in FIG. 15.

FIGS. 15 and 16 show an accessory mount 500 according to another embodiment of the invention. Accessory mount 500 cooperates with base 46 so as to provide the laterally orthogonal adjustable engagement interface 52 therebetween. Accessory engagement interface 502 defined by accessory mount 500 includes a channel 504 that is flanked by opposing sidewalls 506, 508. One or more openings 510 are associated with accessory engagement interface 502 and offset from channel 504 for securing accessories having alternate engagement interfaces relative to accessory mount 500.

Figure 17:
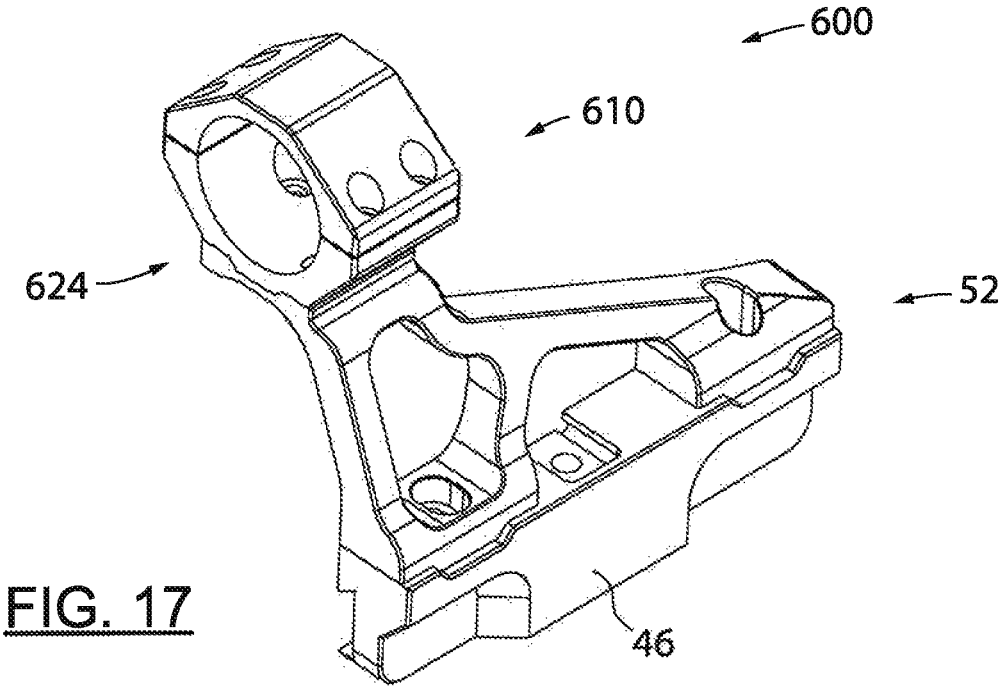
FIG. 17 is a view similar to FIG. 13 and shows an accessory support in the form of a scope ring assembly associated with the base of the accessory mounting system shown in FIG. 3.
Figure 18:
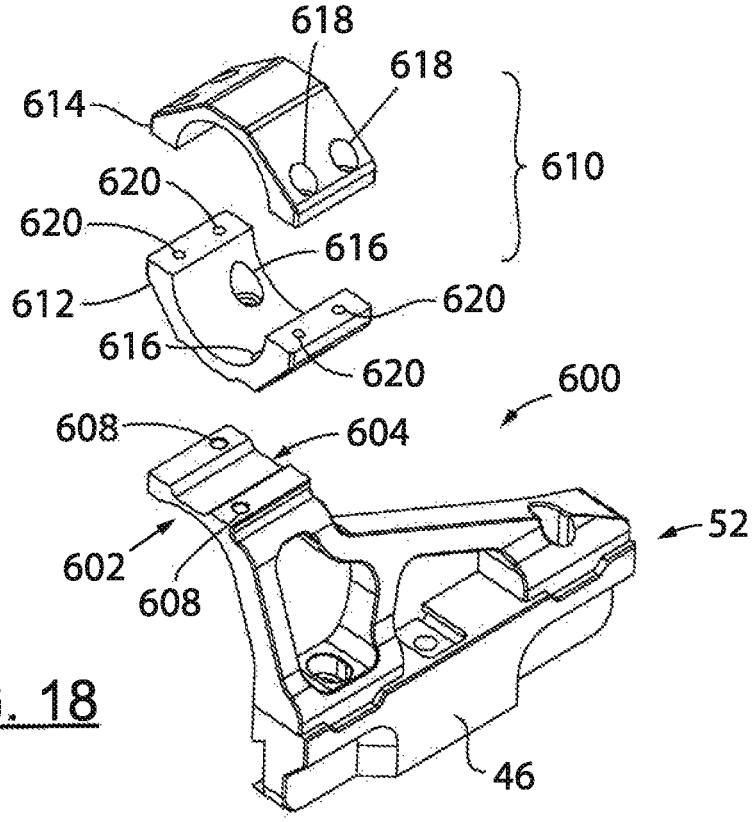
FIG. 18 is an exploded perspective view of the accessory mounting system shown in FIG. 17.
Figure 19:
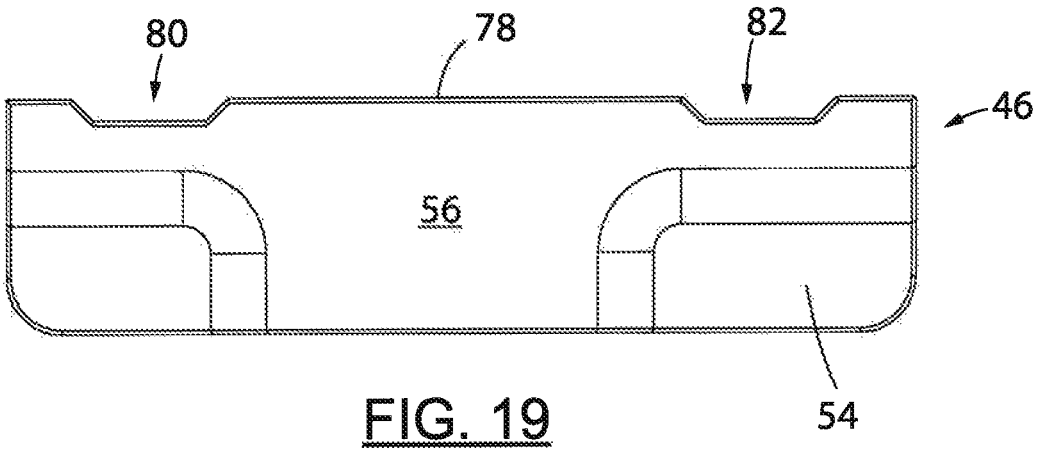
FIG. 19 is as atmosphere facing side elevation view of the base of the accessory mounting system shown in FIG. 3.
Figure 20:
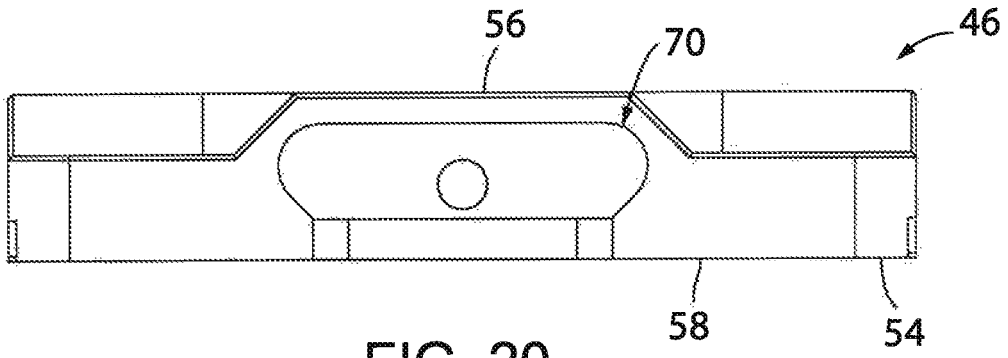
FIG. 20 bottom plan view of the base shown in FIG. 19.
Figure 21:
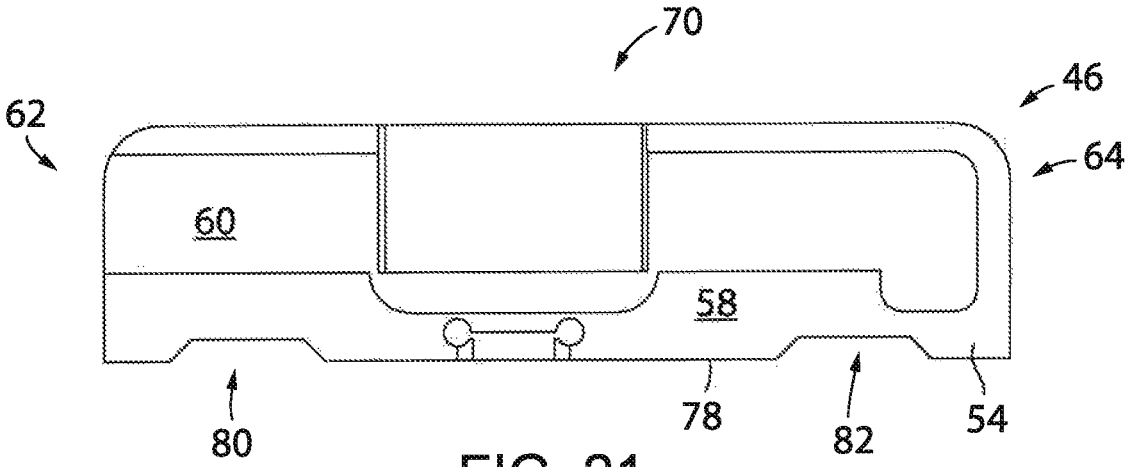
FIG. 21 is a firearm facing side elevation view of the base shown in FIG. 19.
Figure 22:
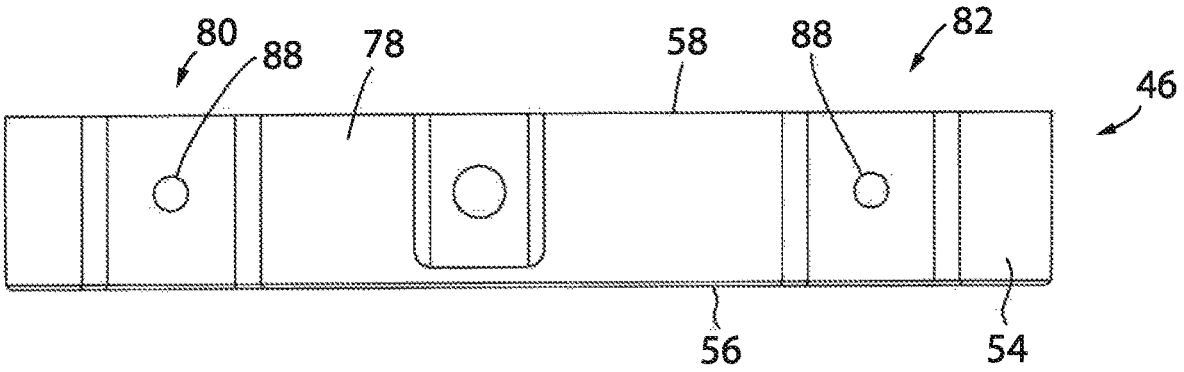
FIG. 22 is top plan view of the base shown in FIG. 19.
Figure 23:
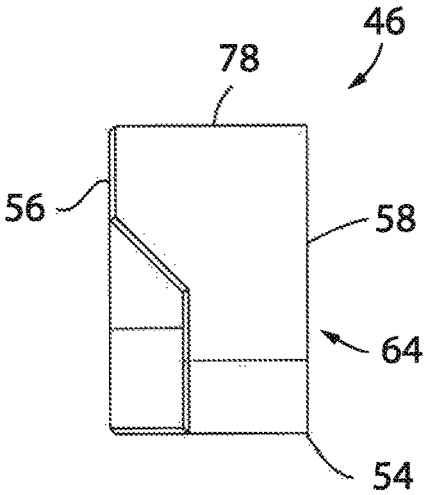
FIG. 23 is a rear elevation view of the base shown in FIG. 19.
Figure 24:
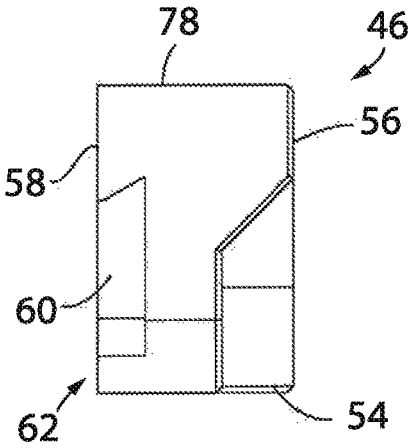
FIG. 24 is a forward elevation view of the base shown in FIG. 19.

FIGS. 17 and 18 show an accessory mount 600 according to another embodiment of the invention engaged with base 46 so as to maintain the operability of engagement interface 52 as described above. Accessory mount 600 includes an accessory engagement interface 602 generally defined by a channel 604 and one or more openings 606, 608 somewhat similar to accessory mount 500. Engagement interface 602 associated with accessory mount 600 is constructed to cooperate with an accessory securing arrangement in the form of a scope ring 610. Scope ring 610 includes a first or lower portion 612 and an upper portion 614 that is constructed to be secured to the lower portion 612. Lower portion 612 of scope ring 610 includes opposing cutouts 616 oriented and constructed to secure lower portion 612 of scope ring 610 relative to engagement interface 602 of accessory mount 600. Association of respective fasteners (not shown) with respective openings 618 associated with upper portion 614 of scope ring 610 and operatively engage with respective threaded openings 620 of lower portion 612 of scope ring 610 defines a generally circular cross-sectional opening 624 configured to receive circular sighting optics such as scopes or the like.

Scope ring 610 is constructed to securely engage a respective scope associated with opening 624 and be secured to accessory interface 602 associated with accessory mount 600 and secured to base 46 such that once the desired lateral orientation of accessory mount 600 relative to base 46 is obtained, such as during a sighting operation, accessory mount assembly 600, and the scope associated therewith, can be readily and repeatedly associated with the underlying firearm via the desired selective engagement and disengagement of base 46 from mount plate 20.

Each of the mount assemblies disclosed herein provide firearm accessory mounting arrangements that allows a shooter to quickly and repeatably configure a firearm assembly for shooting with the assistance of an accessory or displacement of the accessory from the underlying firearm. Each mount assembly is further constructed to provide an adjustable cooperation between the respective accessory mount and the underlying base that provides improved longitudinal and lateral adjustment of the orientation of the accessory relative to the underlying firearm to provide the desired relief and/or positioning of the accessory relative to the underlying firearm to achieve the desired operability of the respective accessory.

Referring to FIGS. 19-24, which each shows a discrete respective orthogonal side of base 46 with the quick release assembly and any respective accessory support removed therefrom, the generally spaced association of channels 80, 82 along the longitudinal axis of body 54 and the orthogonally extending direction associated with the orientation of channels 80, 82 relative to the firearm facing channel 60 associated with engaging the mount plate secured to an underlying firearm allow base 46 to be repeatedly associated with an underlying firearm and provides a highly repeatable orthogonal orientation of the discrete accessory mounts relative to the underlying base. Said in another way, the spaced relationship and upwardly facing open construction of channels 80, 82 provides a tactile indication as to the desired orientation of a respective accessory support relative to base 46 upon even loose association of a respective accessory support with base 46. When a respective accessory support is secured to base 46 via engagement of fasteners with threaded openings 88, the cooperation of the projections associated with a lower facing side of the respective accessory support with the plurality of surfaces associated with channels 80, 82 defined by base 46 provides a robust fore, aft, and rotational directions fixed connection between a respective accessory support and base 46. Further, the substantially open and non-overlapping construction associated with the cooperation of the projections and channels 80, 82 allows the expedient remove of debris or other obstructions which could hinder the desired secure mechanical connection between a discrete accessory mount and base 46.

The present invention has been described in terms of a preferred embodiment directed to an assembly as generally shown in the drawings. It is recognized that equivalents, alternatives, and modifications, aside from those expressly stated, the summarized embodiments, or the embodiment shown in the drawings, are possible and within the scope of the appending claims. The appending claims cover all such alternatives and equivalents.

What is claimed is:

1. A firearm accessory mounting system comprising:

a base that is constructed to removably cooperate with a mount plate that is affixed to a receiver of an underlying firearm;

an accessory support that is constructed to be secured to the base such that a longitudinal axis of the accessory support is adjustable in a lateral direction relative to a longitudinal axis of the mount plate; and an engagement interface formed between the base and the accessory support, the engagement interface being constructed to provide an orthogonal association of the accessory support relative to the base throughout a range of adjustment of the accessory support relative to the base with respect to the lateral direction, wherein the engagement interface is defined by a respective channel formed in at least one of the base and the accessory support and a respective projection formed in the other of the at least one of the base and the accessory support, wherein the channel and projection are constructed to engage one another from a vertical direction for retention to one another when the base is secured to the mount plate, wherein a cross sectional area of each of the channel and the projection decrease as the channel and the projection progress in a downward direction relative to a top surface of the base, and wherein each of the channel and the projection are configured to receive a fastener therethrough while allowing selectively slidable lateral orthogonal translation of the accessory support relative to the base.

2. The firearm accessory mounting system of claim 1 further comprising a quick release supported by the base and operable between an open position wherein the base is movable relative to the mount plate and a closed position wherein the base is secured to the mount plate in a manner that tolerates operation of the underlying firearm without translation of the base relative to the mount plate.

3. The firearm accessory mounting system of claim 1 wherein the channel and the projection have corresponding trapezoidal shapes.

4. The firearm accessory mounting system of claim 1 further comprising a fastener associated with a fastener passage through the channel and the projection.

5. The firearm accessory mounting system of claim 4 wherein the fastener passage associated with the accessory support has an oblong shape defined by an axis that extends in the lateral direction.

6. The firearm accessory mounting system of claim 1 wherein the engagement interface is further defined as a first engagement interface, and further comprises a second engagement interface, wherein the first and second engagement interfaces each comprise a channel formed in the base and a projection defined by the accessory support.

7. The firearm accessory mounting system of claim 1 further comprising a plurality of accessory supports wherein each respective accessory support is constructed to interchangeably cooperate with the base via the engagement interface.

8. The firearm accessory mounting system of claim 1 wherein the accessory support includes an accessory engagement interface comprising a plurality of projections and grooves for securing an accessory.

9. The firearm accessory mounting system of claim 1 wherein the channel is formed in the base and the projection is defined by the accessory support, and further comprising a fastener passage associated with the channel and projection.

10. A firearm accessory mounting system comprising:

a base having a channel formed in a firearm facing side of the base and constructed to slideably cooperate with a mount plate secured to a receiver of a firearm;

an accessory support constructed to cooperate with the base, the accessory support including an accessory engagement interface for securing an accessory;

a first channel and a second channel defined by one of the base and the accessory support; and a first projection and a second projection defined by the other of the base and the accessory support, the first projection being constructed to cooperate with the first channel and the second projection being constructed to cooperate with the second channel to align a longitudinal axis of the base with a longitudinal axis of the accessory support when the accessory support is secured to the base, wherein the first projection and the second projection are constructed to removeably engage with a respective one of the first channel and the second channel in a vertical direction for retention to one another, wherein a respective cross sectional area of each of the first channel, the second channel, the first projection, and the second projection decreases as each respective one of the first channel, the second channel, the first projection, and the second channel progresses in a downward direction relative to a top surface of the base, and wherein each of the first channel and the first projection are configured to receive a first fastener therethrough, and each of the second channel and the second projection are configured to receive a second fastener therethrough, while allowing selectively slideable lateral orthogonal translation of the accessory support relative to the base.

11. The firearm accessory mounting system of claim 10 wherein the first and second channels are defined by the base and the first and second projections are defined by the accessory support, and wherein the accessory support further comprises a first oblong opening and a second oblong opening that each extend through the accessory support in a vertical direction wherein each of the first oblong opening and the second oblong opening is aligned with a respective pair of the first channel and the first projection and the second channel and the second projection.

12. The firearm accessory mounting system of claim 11 further comprising a fastener constructed to pass through a respective one of the first oblong opening and the second oblong opening and cooperate with a respective threaded passage defined by the base.

13. The firearm accessory mounting system of claim 10 further comprising a quick release assembly supported by the base and operable to selectively secure the base to the mount plate.

14. The firearm accessory mounting system of 10 further comprising a plurality of accessory supports wherein each accessory support is constructed to interchangeably cooperate with the base.

15. The firearm accessory mounting system of claim 10 wherein each of the first projection and the second projection and the first channel and the second channel have a tapered cross sectional shape.

16. A method of forming a firearm accessory mounting system, the method comprising:

providing a base that removably cooperates with a mount plate secured to a rearward portion of a firearm;

defining a first and a second base indexing structure with a vertically facing surface of the base;

providing a plurality of accessory mounts that each cooperate with the base and are securable relative thereto at a single respective longitudinal position;

defining a first and a second accessory mount indexing structure with a downward facing surface of each of the plurality of accessory mounts such that the first accessory mount indexing structure is configured to slideably cooperate with the first base indexing structure and the second accessory mount indexing structure is configured to slideably cooperate with the second base indexing structure when a respective one of the plurality of accessory mounts is vertically translated relative to the base such that each of the first and second accessory mount indexing structures are constructed to engage a respective one of the first base indexing structure and the second base indexing structure in a vertical direction for retention to one another when a respective accessory mount is secured to the base, wherein a cross sectional area of each of the first and second base indexing structures decrease as the base indexing structure progresses in a downward direction relative to a top surface of the base; and providing an accessory engagement interface supported by the plurality of accessory mounts, the accessory engagement interface for selectively securing an accessory relative to the firearm, and wherein each of the first base indexing structure and the first accessory mount indexing structure are configured to receive a first fastener therethrough, and each of the second base indexing structure and the second accessory mount indexing structure are configured to receive a second fastener therethrough, while allowing selectively slideable lateral orthogonal translation of the accessory support relative to the base.

17. The method of claim 16 wherein each of the plurality of accessory mounts include an opening that is aligned with each of the first and second accessory mount indexing structures.

18. The method of claim 17 further comprising forming each opening to have an oblong shape.

19. The method of claim 16 further comprising forming a threaded passage in the base that is aligned with each of the first base indexing structure and the second base indexing structure and configured to cooperate with a respective fastener associated with a respective opening formed in a respective one of the plurality of accessory mounts when the respective one of the accessory mounts is secured thereto.

20. The method of claim 16 further comprising a plurality of fasteners wherein each fastener passes through a respective one of the plurality of accessory mounts and cooperates with the base to secure the respective one of the plurality of accessory mounts relative to the base.

* * * * *